US007434751B1

(12) United States Patent
Chen

(10) Patent No.: US 7,434,751 B1
(45) Date of Patent: Oct. 14, 2008

(54) WATER SPRAYING GUN HAVING DIFFERENT SPRAYING TYPES

(75) Inventor: Chin-Yuan Chen, Changhua Hsien (TW)

(73) Assignee: Shin Tai Spurt Water of the Garden Tools Co., Ltd., Changhua Hsien (TW)

( * ) Notice: Subject to any disclaimer, the term of this patent is extended or adjusted under 35 U.S.C. 154(b) by 105 days.

(21) Appl. No.: 11/649,024

(22) Filed: Jan. 3, 2007

(51) Int. Cl.
*B05B 7/02* (2006.01)

(52) U.S. Cl. ..... 239/526; 239/447; 239/449; 239/458; 239/525; 239/581.1

(58) Field of Classification Search ..... 239/446, 239/447, 448, 449, 456, 457, 458, 525, 526, 239/581.1
See application file for complete search history.

(56) References Cited

U.S. PATENT DOCUMENTS 3,163,363 A * 12/1964 Travis ..... 239/458
3,363,842 A * 1/1968 Burns ..... 239/449
3,514,042 A * 5/1970 Freed ..... 239/458
4,785,998 A * 11/1988 Takagi ..... 239/446
5,333,792 A * 8/1994 Wang ..... 239/526

* cited by examiner

*Primary Examiner*—Steven J Ganey
(74) *Attorney, Agent, or Firm*—Alan Kamrath; Kamrath & Associates PA

(57) ABSTRACT

A water spraying gun includes a main body, a water supply member, a water outlet seat, a nozzle module, a control switch, and a rotation member. Thus, the water is injected outwardly from the water injection hole of the nozzle module or sprinkled outwardly from the water sprinkling holes of the nozzle module, so that the water spraying gun have different water outlet modes, thereby enhancing the versatility of the water spraying gun. In addition, the different water outlet modes are changed and controlled by rotation of the rotation member, thereby facilitating the user controlling the different water outlet modes. Further, the water flow rate from the nozzle module is controlled independently by rotation of the control handle.

20 Claims, 8 Drawing Sheets

WATER SPRAYING GUN HAVING DIFFERENT SPRAYING TYPES

BACKGROUND OF THE INVENTION

1. Field of the Invention

The present invention relates to a water spraying gun and, more particularly, to a water spraying gun available for a gardening work.

2. Description of the Related Art

A conventional water spraying gun comprises a gun body having a water outlet portion, and a nozzle rotatably mounted on the gun body and having different water outlet ports that are movable to align with the water outlet portion of the gun body by rotation of the nozzle relative to the gun body. Thus, the different water outlet ports are movable to align with the water outlet portion of the gun body by rotation of the nozzle relative to the gun body, so that the water from gun body is sprayed outwardly from the nozzle in different water outlet modes. However, the diffusion angle and intensity of the water sprayed outwardly from the nozzle is fixed and cannot be adjusted, thereby limiting the versatility of the water spraying gun. In addition, the water sprayed outwardly from the nozzle has a smaller flow rate, so that the water spraying gun is not available for a larger plant, such as the tree and the like. Further, the water flow rate of the water spraying gun is fixed and cannot be adjusted, thereby limiting the versatility of the water spraying gun.

BRIEF SUMMARY OF THE INVENTION

The primary objective of the present invention is to provide a water spraying gun having different spraying types and shapes and different water flow rates.

Another objective of the present invention is to provide a water spraying gun, wherein the water is injected outwardly from the water injection hole of the nozzle module or sprinkled outwardly from the water sprinkling holes of the nozzle module, so that the water spraying gun have different water outlet modes, thereby enhancing the versatility of the water spraying gun.

A further objective of the present invention is to provide a water spraying gun, wherein the different water outlet modes are changed and controlled by rotation of the rotation member, thereby facilitating the user controlling the different water outlet modes.

A further objective of the present invention is to provide a water spraying gun, wherein the water flow rate from the nozzle module is controlled independently by rotation of the control handle.

A further objective of the present invention is to provide a water spraying gun, wherein the nozzle module is axially movable relative to the water outlet seat when the nozzle module is rotatable relative to the water outlet seat to change a distance between the water injection hole of the nozzle module and the water control section of the water outlet seat so as to adjust the diffusion angle and intensity of the water injected outwardly from the water injection hole of the nozzle module.

Further benefits and advantages of the present invention will become apparent after a careful reading of the detailed description with appropriate reference to the accompanying drawings

BRIEF DESCRIPTION OF THE SEVERAL VIEWS OF THE DRAWING(S)

DETAILED DESCRIPTION OF THE INVENTION

Figure 1:
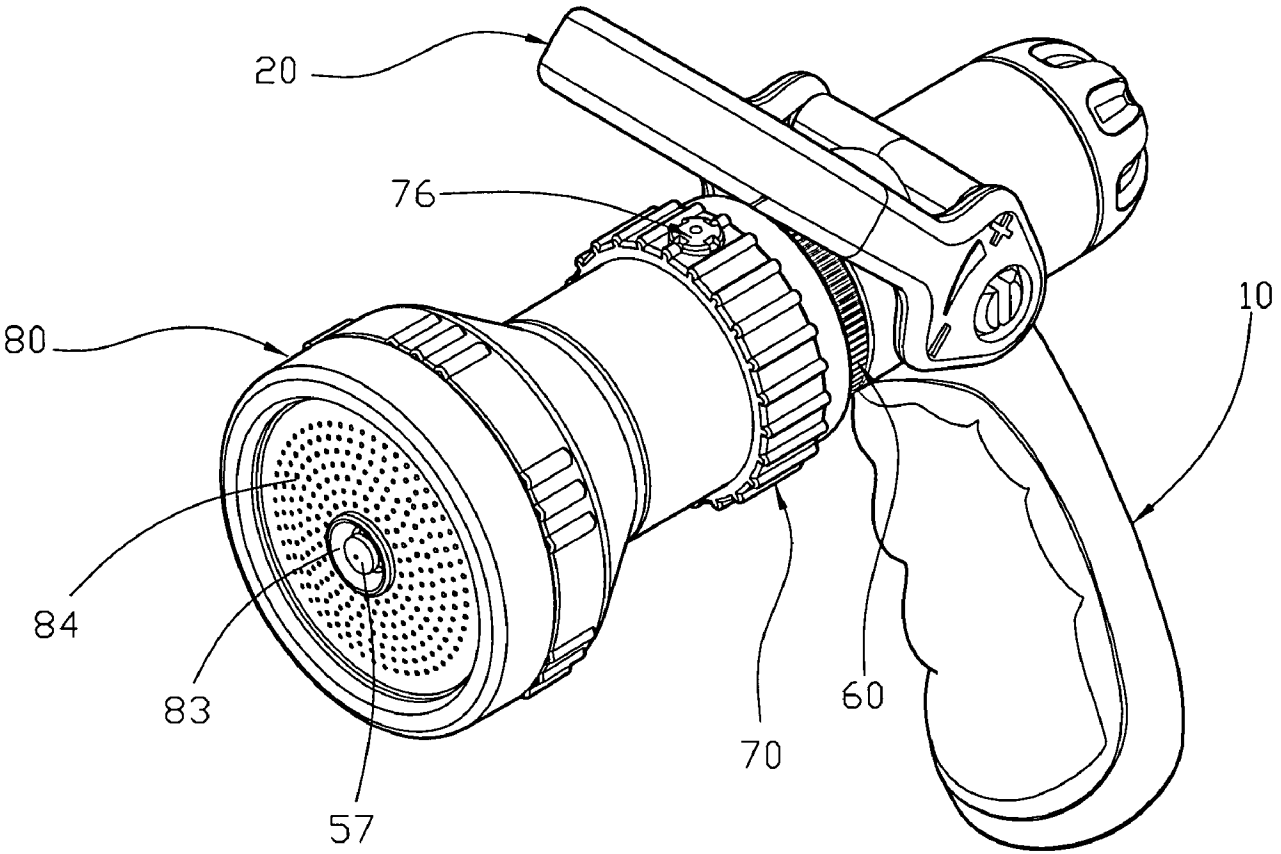
FIG. 1 is a perspective view of a water spraying gun in accordance with the preferred embodiment of the present invention.
Figure 2:
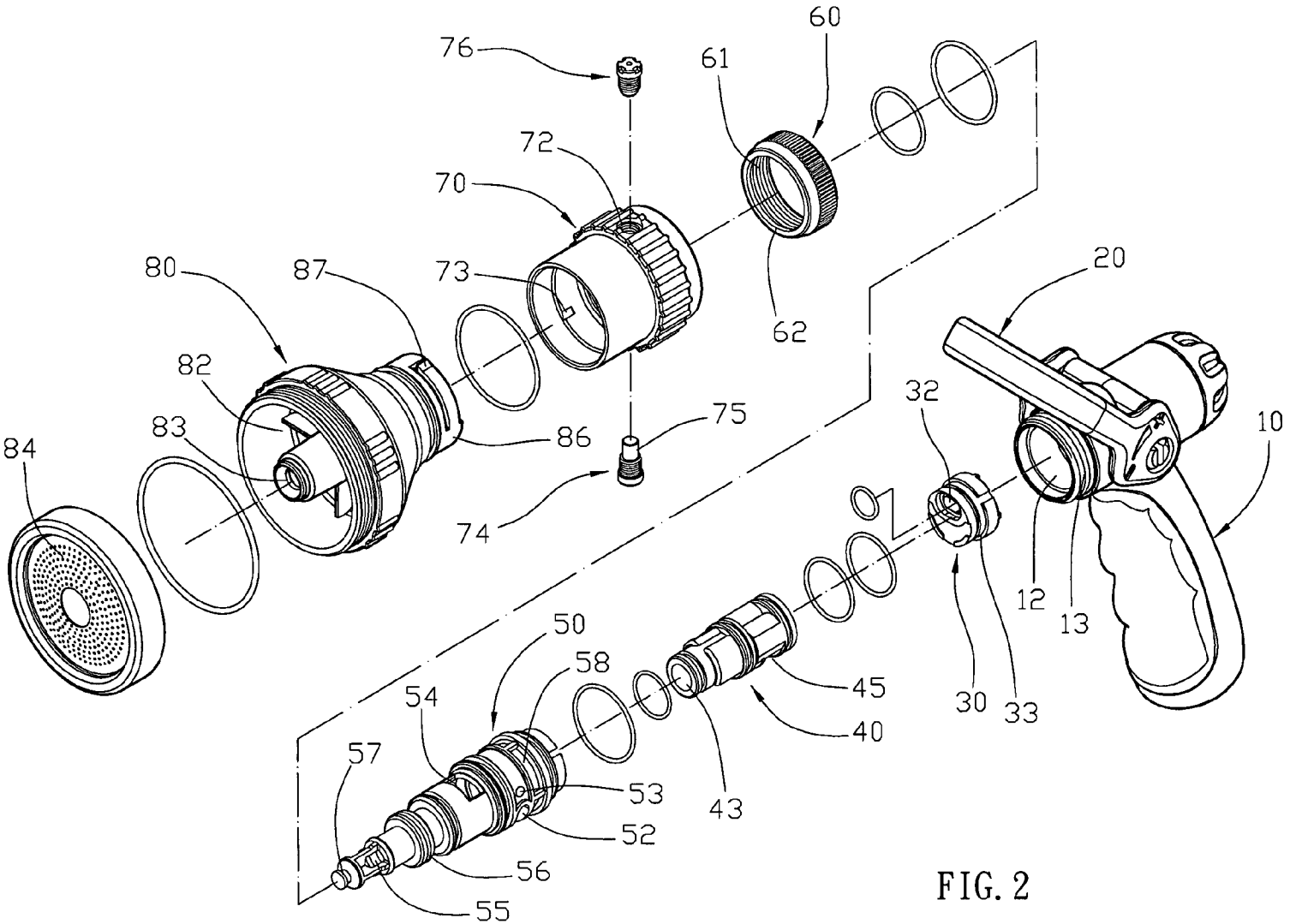
FIG. 2 is an exploded perspective view of the water spraying gun as shown in FIG. 1.
Figure 3:
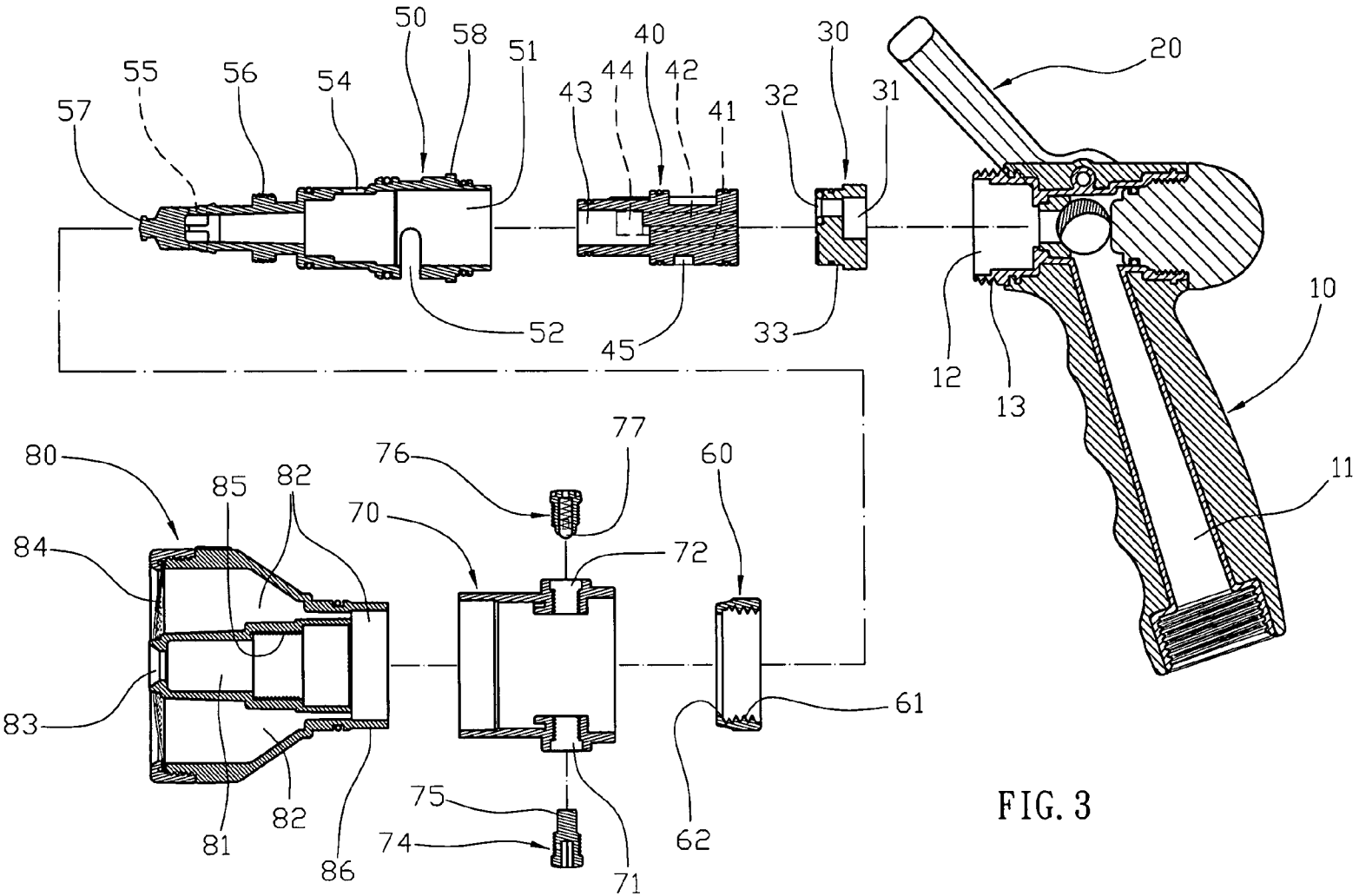
FIG. 3 is a side exploded cross-sectional view of the water spraying gun as shown in FIG. 1.
Figure 4:
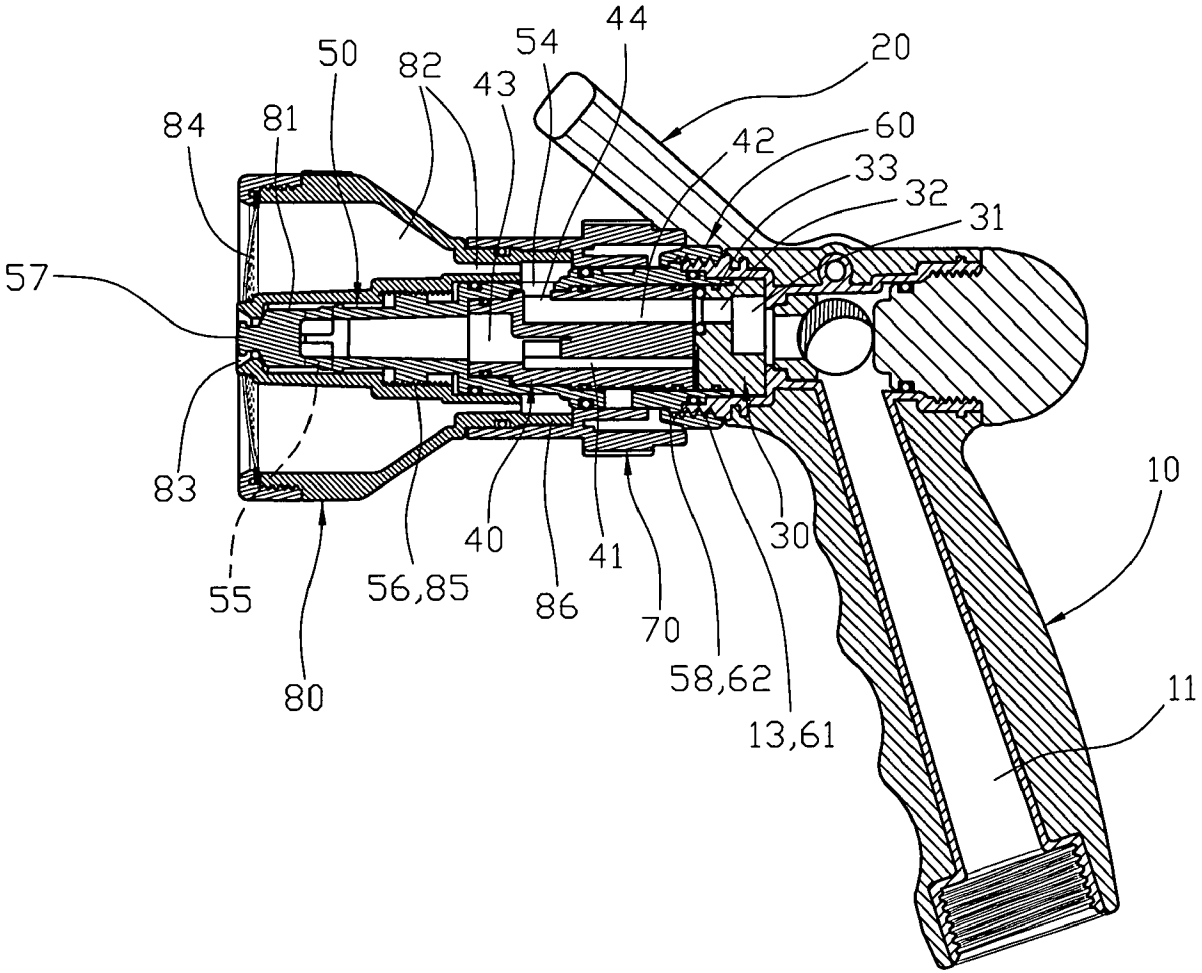
FIG. 4 is a cross-sectional assembly view of the water spraying gun as shown in FIG. 3.
Figure 5:
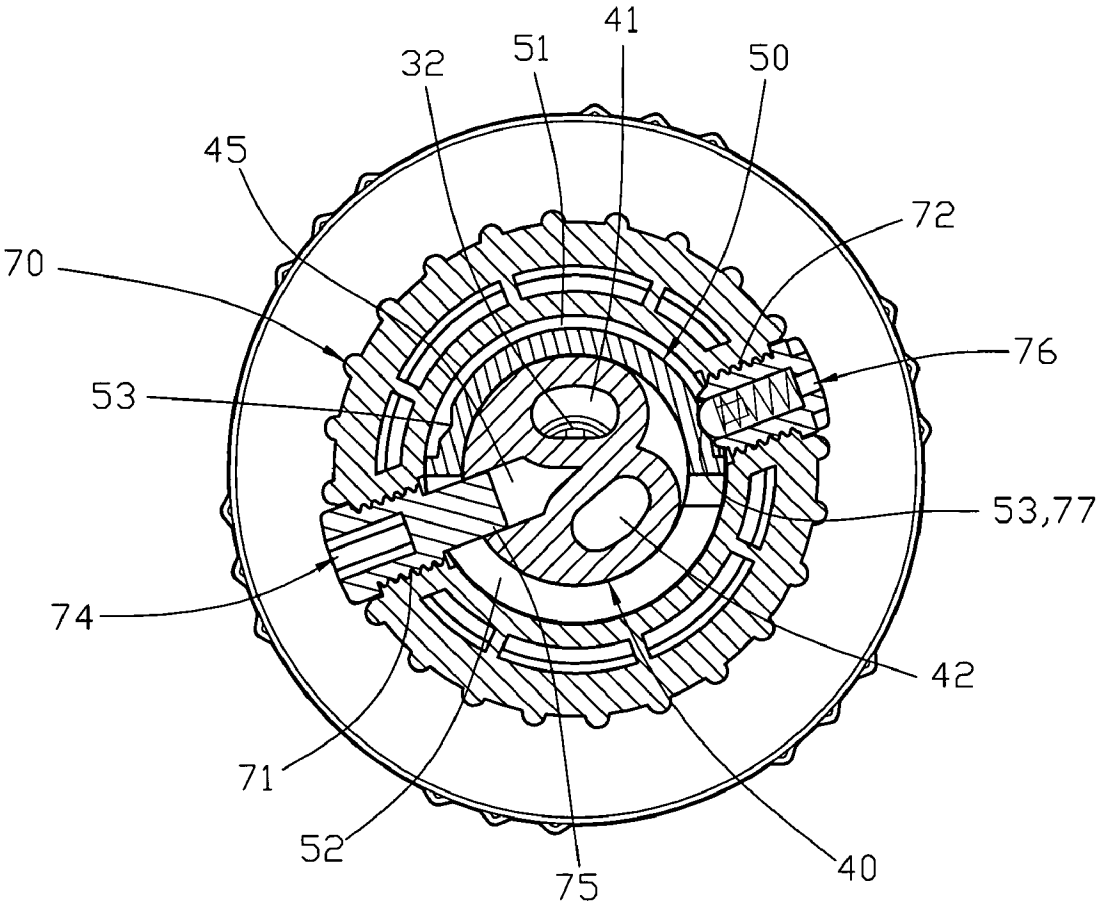
FIG. 5 is a rear cross-sectional view of the water spraying gun as shown in FIG. 1.

Referring to the drawings and initially to FIGS. 1-5, a water spraying gun in accordance with the preferred embodiment of the present invention comprises a main body 10 having an inside formed with a water inlet channel 11, a water supply member 30 mounted on the main body 10 and connected to the water inlet channel 11 of the main body 10, a water outlet seat 50 having a first end mounted on the main body 10 and a second end formed with a first water outlet port 55 and having a peripheral wall formed with a second water outlet port 54, a nozzle module 80 mounted on the water outlet seat 50 and having an inside formed with a water injection passage 81 connected to the first water outlet port 55 of the water outlet seat 50 and a peripheral wall formed with a water sprinkling passage 82 connected to the second water outlet port 54 of the water outlet seat 50, a control switch 40 rotatably mounted in the water outlet seat 50 and having a first end formed with a first water inlet conduit 41 that is movable to connect the water supply member 30 and a second water inlet conduit 42 that is movable to connect the water supply member 30, and a second end formed with a first water outlet conduit 43 connected to the first water inlet conduit 41 and the first water outlet port 55 of the water outlet seat 50 and a second water outlet conduit 44 connected to the second water inlet conduit 42 and the second water outlet port 54 of the water outlet seat 50, and a rotation member 70 rotatably mounted on the water outlet seat 50 and secured to the control switch 40 to rotate the control switch 40.

The main body 10 has an end portion having an inner wall formed with a mounting recess 12 to receive the water supply member 30 and the first end of the water outlet seat 50 and an outer wall formed with an outer thread 13. The water inlet channel 11 of the main body 10 is connected to a water source (not shown).

The water supply member 30 has a first end formed with a water inlet hole 31 connected to the water inlet channel 11 of the main body 10 and a second end formed with a water outlet hole 32 connected to the water inlet hole 31. The water supply member 30 has an outer wall formed with a limit flange 33 to limit the first end of the water outlet seat 50.

The control switch 40 is located between the water outlet seat 50 and the water supply member 30. The control switch 40 has an outer wall formed with a fixing groove 45.

The rotation member 70 has a peripheral wall formed with a screw bore 71 and a screw hole 72 and has an inner wall formed with at least one locking groove 73.

The nozzle module 80 is mounted on the second end of the water outlet seat 50 and is rotatable relative to the water outlet seat 50. The nozzle module 80 has a first end formed with a mounting portion 86 mounted in the rotation member 70 and a second end having a central portion formed with a water injection hole 83 connected to the water injection passage 81 and a peripheral wall formed with a plurality of water sprinkling holes 84 connected to the water sprinkling passage 82. The mounting portion 86 of the nozzle module 80 has an outer wall formed with a locking hook 87 that is movable to rest on the locking groove 73 of the rotation member 70. The water sprinkling passage 82 of the nozzle module 80 is enclosed around the water injection passage 81. The water injection passage 81 of the nozzle module 80 has a wall formed with a threaded adjusting portion 85.

The water outlet seat 50 has an inside formed with a mounting chamber 51 connected to the first water outlet port 55 and the second water outlet port 54 to receive the control switch 40 and the water supply member 30. The water outlet seat 50 has an outer wall having a first arc-shaped portion formed with an adjusting slot 52 aligning with the fixing groove 45 of the control switch 40 and a second arc-shaped portion formed with two spaced positioning grooves 53. The first end of the water outlet seat 50 has an outer wall formed with an outwardly extending retaining flange 58. The second end of the water outlet seat 50 has a distal portion formed with a tapered and reduced water control section 57 that is movable relative to the water injection hole 83 of the nozzle module 80 when the nozzle module 80 is axially movable relative to the water outlet seat 50. The second end of the water outlet seat 50 has an outer wall formed with a threaded adjusting section 56 located between the first water outlet port 55 and the second water outlet port 54 and screwed into the threaded adjusting portion 85 of the nozzle module 80.

The water spraying gun further comprises a locking screw 74 screwed into the screw bore 71 of the rotation member 70 and having a distal end provided with a drive stub 75 slidable in the adjusting slot 52 of the water outlet seat 50 and fixed in the fixing groove 45 of the control switch 40 to rotate the control switch 40 by rotation of the rotation member 70, and a positioning screw 76 screwed into the screw hole 72 of the rotation member 70 and having a distal end provided with a spring-biased positioning ball 77 detachably positioned in one of the positioning grooves 53 of the water outlet seat 50 to position the rotation member 70 on the water outlet seat 50 temporarily.

The water spraying gun further comprises a control handle 20 rotatably mounted on the main body 10 to open or close a connection between the water supply member 30 and the water inlet channel 11 of the main body 10 and to control a water flow rate from the water inlet channel 11 of the main body 10 into the water supply member 30, and a locking nut 60 secured on the water outlet seat 50 and the main body 10 to secure the water outlet seat 50 to the main body 10. The locking nut 60 has an inner wall formed with an inner thread 61 screwed onto the outer thread 13 of the main body 10 and has an end portion formed with an inwardly extending retaining flange 62 rested on the retaining flange 58 of the water outlet seat 50.

In operation, referring to FIGS. 1-6, the water from the water source is introduced through the water inlet channel 11 of the main body 10, the water inlet hole 31 and the water outlet hole 32 of the water supply member 30 into the control switch 40. At this time, the flow rate of the water into the control switch 40 is controlled by rotation of the control handle 20. In addition, the control switch 40 is rotatable relative to the water supply member 30 by rotation of the rotation member 70.

Figure 6:
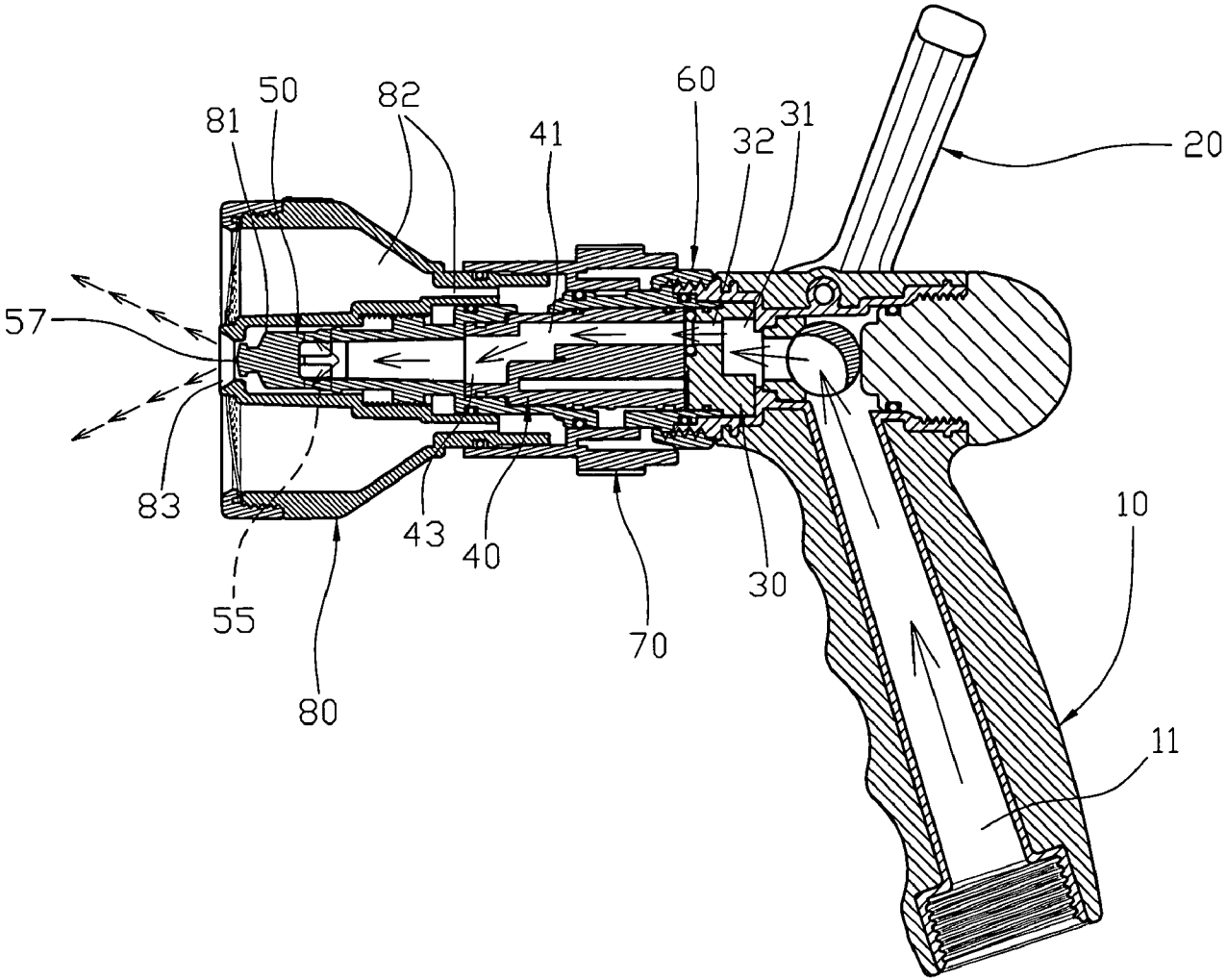
FIG. 6 is a schematic operational view of the water spraying gun as shown in FIG. 4.

As shown in FIG. 6, when the first water inlet conduit 41 of the control switch 40 is movable to align with the water outlet hole 32 of the water supply member 30, the water in the water supply member 30 in turn flows through the first water inlet conduit 41 of the control switch 40, the first water outlet conduit 43 of the control switch 40, the first water outlet port 55 of the water outlet seat 50 and the water injection passage 81 of the nozzle module 80 and is injected outwardly from the water injection hole 83 of the nozzle module 80. At this time, the flow rate of the water injected outwardly from the water injection hole 83 of the nozzle module 80 is controlled by rotation of the control handle 20. In addition, the positioning ball 77 of the positioning screw 76 is positioned in one of the positioning grooves 53 of the water outlet seat 50 to position the rotation member 70 on the water outlet seat 50 temporarily.

Figure 7:
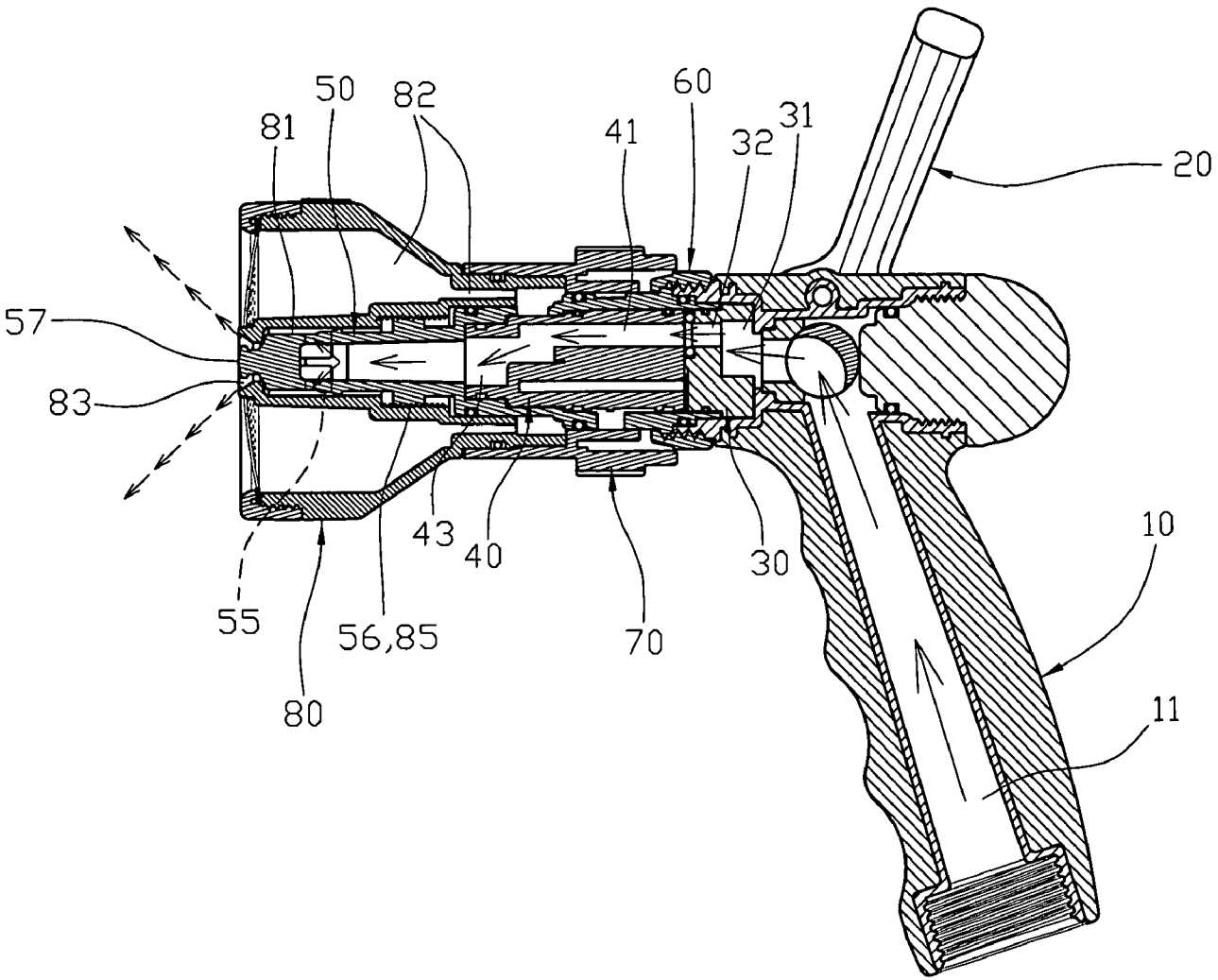
FIG. 7 is a schematic operational view of the water spraying gun as shown in FIG. 6.

As shown in FIG. 7, the threaded adjusting section 56 of the water outlet seat 50 is screwed into the threaded adjusting portion 85 of the nozzle module 80, so that the nozzle module 80 is axially movable relative to the water outlet seat 50 when the nozzle module 80 is rotatable relative to the water outlet seat 50 to change a distance between the water injection hole 83 of the nozzle module 80 and the water control section 57 of the water outlet seat 50 so as to adjust the diffusion angle and intensity of the water injected outwardly from the water injection hole 83 of the nozzle module 80. At this time, when the nozzle module 80 is movable outwardly relative to the water outlet seat 50 to the outermost position where the locking hook 87 of the nozzle module 80 is locked in the locking groove 73 of the rotation member 70, the nozzle module 80 is locked by the rotation member 70 to stop rotation of the nozzle module 80 to prevent the nozzle module 80 from being detached from the water outlet seat 50.

Figure 8:
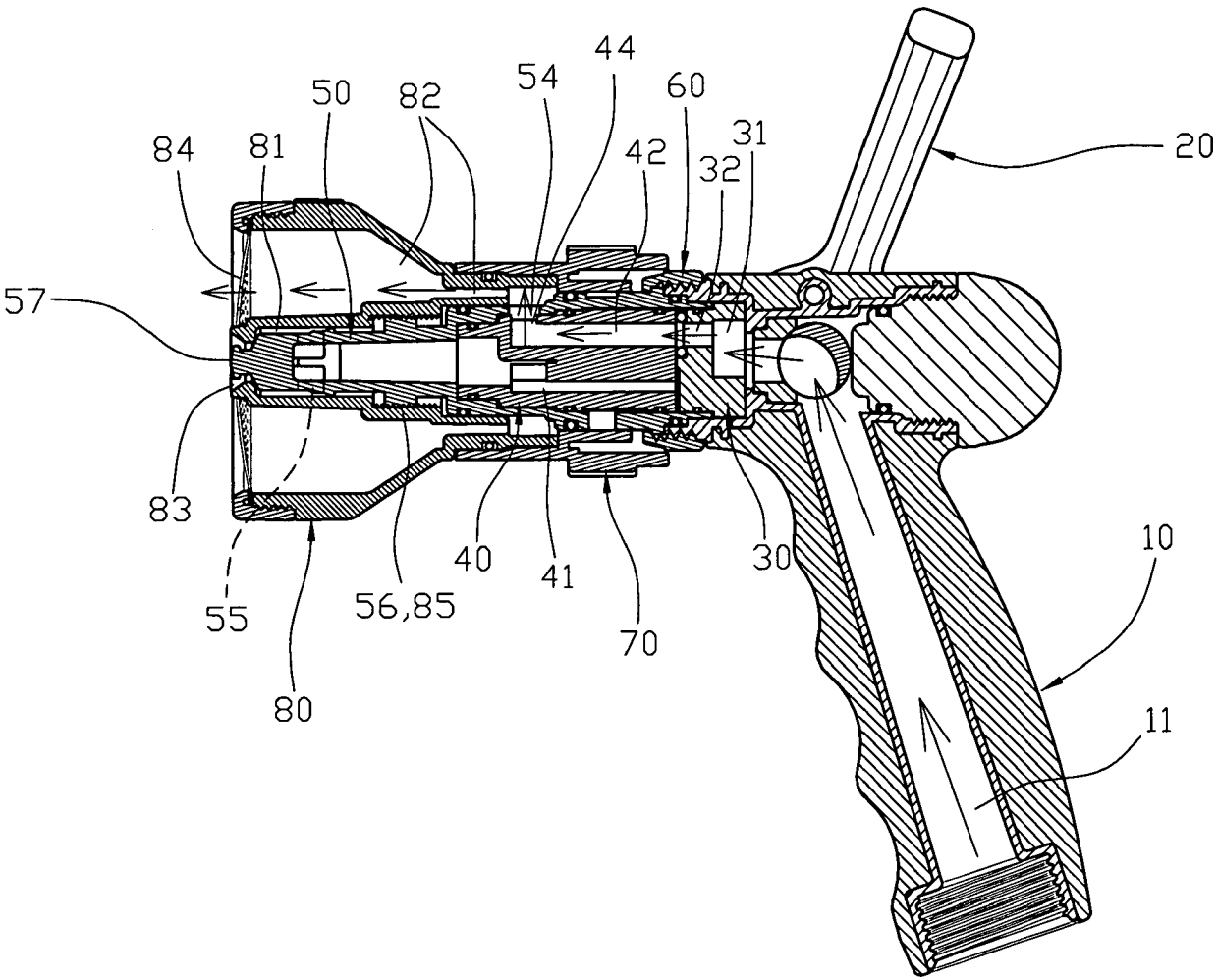
FIG. 8 is a schematic operational view of the water spraying gun as shown in FIG. 4.

As shown in FIG. 8, when the second water inlet conduit 42 of the control switch 40 is movable to align with the water outlet hole 32 of the water supply member 30, the water in the water supply member 30 in turn flows through the second water inlet conduit 42 of the control switch 40, the second water outlet conduit 44 of the control switch 40, the second water outlet port 54 of the water outlet seat 50 and the water sprinkling passage 82 of the nozzle module 80 and is sprinkled outwardly from the water sprinkling holes 84 of the nozzle module 80. At this time, the flow rate of the water sprinkled outwardly from the water sprinkling holes 84 of the nozzle module 80 is controlled by rotation of the control handle 20.

Accordingly, the water is injected outwardly from the water injection hole 83 of the nozzle module 80 or sprinkled outwardly from the water sprinkling holes 84 of the nozzle module 80, so that the water spraying gun have different water outlet modes, thereby enhancing the versatility of the water spraying gun. In addition, the different water outlet modes are changed and controlled by rotation of the rotation member 70, thereby facilitating the user controlling the different water outlet modes. Further, the water flow rate from the nozzle module 80 is controlled independently by rotation of the control handle 20. Further, the nozzle module 80 is axially movable relative to the water outlet seat 50 when the nozzle module 80 is rotatable relative to the water outlet seat 50 to change a distance between the water injection hole 83 of the nozzle module 80 and the water control section 57 of the water outlet seat 50 so as to adjust the diffusion angle and intensity of the water injected outwardly from the water injection hole 83 of the nozzle module 80.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A water spraying gun, comprising:

a main body having an inside formed with a water inlet channel;

a water supply member mounted on the main body and connected to the water inlet channel of the main body;

a water outlet seat having a first end mounted on the main body and a second end formed with a first water outlet port and having a peripheral wall formed with a second water outlet port;

a nozzle module mounted on the water outlet seat and having an inside formed with a water injection passage connected to the first water outlet port of the water outlet seat and a peripheral wall formed with a water sprinkling passage connected to the second water outlet port of the water outlet seat;

a control switch rotatably mounted in the water outlet seat and having a first end formed with a first water inlet conduit that is movable to connect the water supply member and a second water inlet conduit that is movable to connect the water supply member, and a second end formed with a first water outlet conduit connected to the first water inlet conduit and the first water outlet port of the water outlet seat and a second water outlet conduit connected to the second water inlet conduit and the second water outlet port of the water outlet seat;

a rotation member rotatably mounted on the water outlet seat and secured to the control switch to rotate the control switch.

2. The water spraying gun in accordance with claim 1, wherein the nozzle module has a first end formed with a mounting portion mounted in the rotation member and a second end having a central portion formed with a water injection hole connected to the water injection passage and a peripheral wall formed with a plurality of water sprinkling holes connected to the water sprinkling passage.

3. The water spraying gun in accordance with claim 2, wherein the water injection passage of the nozzle module has a wall formed with a threaded adjusting portion, and the second end of the water outlet seat has an outer wall formed with a threaded adjusting section located between the first water outlet port and the second water outlet port and screwed into the threaded adjusting portion of the nozzle module.

4. The water spraying gun in accordance with claim 3, wherein the second end of the water outlet seat has a distal portion formed with a tapered and reduced water control section that is movable relative to the water injection hole of the nozzle module when the nozzle module is axially movable relative to the water outlet seat.

5. The water spraying gun in accordance with claim 1, wherein the water outlet seat has an inside formed with a mounting chamber connected to the first water outlet port and the second water outlet port to receive the control switch and the water supply member.

6. The water spraying gun in accordance with claim 1, wherein:

the control switch has an outer wall formed with a fixing groove;

the water outlet seat has an outer wall having a first arc-shaped portion formed with an adjusting slot aligning with the fixing groove of the control switch;

the rotation member has a peripheral wall formed with a screw bore;

the water spraying gun further comprises a locking screw screwed into the screw bore of the rotation member and having a distal end provided with a drive stub slidable in the adjusting slot of the water outlet seat and fixed in the fixing groove of the control switch to rotate the control switch by rotation of the rotation member.

7. The water spraying gun in accordance with claim 6, wherein:

the outer wall of the water outlet seat has a second arc-shaped portion formed with two spaced positioning grooves;

the peripheral wall of the rotation member is formed with a screw hole;

the water spraying gun further comprises a positioning screw screwed into the screw hole of the rotation member and having a distal end provided with a spring-biased positioning ball detachably positioned in one of the positioning grooves of the water outlet seat to position the rotation member on the water outlet seat temporarily.

8. The water spraying gun in accordance with claim 1, further comprising a control handle rotatably mounted on the main body to open or close a connection between the water supply member and the water inlet channel of the main body and to control a water flow rate from the water inlet channel of the main body into the water supply member.

9. The water spraying gun in accordance with claim 8, wherein the nozzle module is axially movable relative to the water outlet seat when the nozzle module is rotatable relative to the water outlet seat to change a distance between the water injection hole of the nozzle module and the water control section of the water outlet seat.

10. The water spraying gun in accordance with claim 9, wherein the rotation member has an inner wall formed with at least one locking groove, and the mounting portion of the nozzle module has an outer wall formed with a locking hook that is movable to rest on the locking groove of the rotation member.

11. The water spraying gun in accordance with claim 10, wherein when the nozzle module is movable outwardly relative to the water outlet seat to an outermost position where the locking hook of the nozzle module is locked in the locking groove of the rotation member, the nozzle module is locked by the rotation member to stop rotation of the nozzle module to prevent the nozzle module from being detached from the water outlet seat.

12. The water spraying gun in accordance with claim 1, further comprising a locking nut secured on the water outlet seat and the main body to secure the water outlet seat to the main body.

13. The water spraying gun in accordance with claim 12, wherein the main body has an end portion having an inner wall formed with a mounting recess to receive the water supply member and the first end of the water outlet seat and an outer wall formed with an outer thread, the first end of the water outlet seat has an outer wall formed with an outwardly extending retaining flange, and the locking nut has an inner wall formed with an inner thread screwed onto the outer thread of the main body and has an end portion formed with an inwardly extending retaining flange rested on the retaining flange of the water outlet seat.

14. The water spraying gun in accordance with claim 1, wherein the water supply member has a first end formed with a water inlet hole connected to the water inlet channel of the main body and a second end formed with a water outlet hole connected to the water inlet hole, the first water inlet conduit of the control switch is movable to align with the water outlet hole of the water supply member, and the second water inlet conduit of the control switch is movable to align with the water outlet hole of the water supply member.

15. The water spraying gun in accordance with claim 1, wherein the water supply member has an outer wall formed with a limit flange to limit the first end of the water outlet seat.

16. The water spraying gun in accordance with claim 1, wherein the control switch is located between the water outlet seat and the water supply member.

17. The water spraying gun in accordance with claim 1, wherein the control switch is rotatable relative to the water supply member by rotation of the rotation member.

18. The water spraying gun in accordance with claim 1, wherein the nozzle module is mounted on the second end of the water outlet seat.

19. The water spraying gun in accordance with claim 1, wherein the nozzle module is rotatable relative to the water outlet seat.

20. The water spraying gun in accordance with claim 1, wherein the water sprinkling passage of the nozzle module is enclosed around the water injection passage.

* * * * *